US010515582B2

(12) United States Patent
Chin et al.

(10) Patent No.: US 10,515,582 B2
(45) Date of Patent: Dec. 24, 2019

(54) LIGHT EMITTING DIODE DRIVING CIRCUIT AND LIGHT EMITTING DIODE DISPLAY DEVICE

(71) Applicant: SILICON TOUCH TECHNOLOGY INC., Hsinchu (TW)

(72) Inventors: Chi-Yuan Chin, Hsinchu (TW); Kuei-Jyun Chen, Hsinchu (TW)

(73) Assignee: SILICON TOUCH TECHNOLOGY INC., Hsinchu, Taiwan (CN)

( * ) Notice: Subject to any disclaimer, the term of this patent is extended or adjusted under 35 U.S.C. 154(b) by 0 days.

(21) Appl. No.: 15/986,233

(22) Filed: May 22, 2018

(65) Prior Publication Data

US 2019/0114956 A1 Apr. 18, 2019

(30) Foreign Application Priority Data

Oct. 13, 2017 (TW) ..... 106135126 A

(51) Int. Cl.
*G09G 3/32* (2016.01)
*G09G 3/34* (2006.01)

(52) U.S. Cl.
CPC ..... *G09G 3/32* (2013.01); *G09G 3/3426* (2013.01); *G09G 2310/0202* (2013.01)

(58) Field of Classification Search
None
See application file for complete search history.

(56) References Cited

U.S. PATENT DOCUMENTS

2008/0088561 A1 4/2008 Kawabe
2009/0174638 A1* 7/2009 Brown Elliott ... G02F 1/133621 345/88
2014/0168037 A1* 6/2014 Sakariya ..... G09G 3/3233 345/82

FOREIGN PATENT DOCUMENTS

TW 200425006 A 11/2004
TW 201248587 A1 12/2012

* cited by examiner

*Primary Examiner* — Joseph R Haley
(74) *Attorney, Agent, or Firm* — Li & Cai Intellectual Property (USA) Office

(57) ABSTRACT

An LED driving circuit is provided in the present disclosure for driving an LED matrix module. The LED matrix module includes a plurality of LED units. The LED driving circuit includes a control module, a first driving module and a switch module. The first driving module is used for driving at least one column of the LED matrix module according to a first driving signal provided by the control module. The switch module is electrically connected to the control module for receiving a second driving signal from the control module to drive the at least one row of the LED units of the LED matrix module.

6 Claims, 6 Drawing Sheets

LIGHT EMITTING DIODE DRIVING CIRCUIT AND LIGHT EMITTING DIODE DISPLAY DEVICE

BACKGROUND OF THE INVENTION

1. Field of the Invention

The present disclosure relates to an LED driving circuit; more particularly, to an LED driving circuit capable of simplifying a circuit layout.

2. Description of Related Art

Recently, due to the progression of LED technology, the resolution for display devices which adopt LEDs has become comparable to liquid crystal devices. However, the electronic attributes of LEDs are different from that of liquid crystal molecules, thus the control method for LED display devices still need to be improved.

Reference is made to FIG. 1, which shows a conventional LED display device including a control module 10, a first driving module 11, a second driving module 12 and an LED matrix module 14. A common control method for the LED matrix module 14 involves the control module providing the first driving module 11 with a control signal to provide a certain column of LED units (not shown in the figure) on the LED matrix module 14 with a driving signal. After that, the control module 10 provides the second driving module 11 with another driving signal. The second driving module includes a plurality MOSFETs (Metal-Oxide Semiconductor Field Effect Transistor) formed in parallel form, and each of the MOSFETs controls the on and off of a row of the LED units. However, this circuit layout could be vast and complicated, since each of the MOSFETs is lined with at least one control line. In particular, large-size display devices require a great amount of MOSFETs, which further increases the cost.

Therefore, an LED display device and an LED driving circuit with lower costs are needed in the industry.

SUMMARY OF THE INVENTION

From what is addressed above, an LED driving circuit, adopted to drive an LED matrix module including a plurality of LED units, is provided in the present disclosure. The LED driving circuit includes a control module, a first driving module configured to drive at least one column of the LED units of the LED matrix module according to a first driving signal provided by the control module, and a switch module electrically connected to the control module and configured to receive a second driving signal from the control module to drive the at least one row of the LED units of the LED matrix module.

Preferably, the switch module includes a plurality of switch units and each of the plurality of switch units is a flip-flop (FF).

Preferably, the switch module includes a plurality of switch units and each of the plurality of switch units is a micro controller.

Preferably, the control module, by the switch module, drives each row of the LED units of the LED matrix module in order.

Preferably, the control module, by the switch module, drives an arbitrary row of the LED units of the LED matrix module.

An LED display device is also provided in the present disclosure. The LED display device includes an LED matrix module, a control module, a first driving module and a switch module. The LED matrix module includes a plurality of LED units arranged in a matrix manner. The first driving module is configured to provide a first driving signal to drive at least one column of the LED units of the LED matrix module. The switch module is electrically connected to the control module and is configured to receive a second driving signal from the control module to drive the at least one row of the LED units of the LED matrix module.

Preferably, the switch module includes a plurality of switch units and each of the plurality of switch units is a flip-flop (FF).

Preferably, the switch module includes a plurality of switch units and each of the plurality of switch units is a micro controller.

Preferably, the control module, by the switch module, drives each row of the LED units of the LED matrix module in order.

Preferably, the control module, by the switch module, drives an arbitrary row of the LED units of the LED matrix module.

In sum, the LED driving circuit according to the present disclosure simplifies the circuit layout and decreases the degree of complexity of the control method by utilizing the switch module, whereby the cost can be decreased and the development process of the products can be speeded up.

For further understanding of the present disclosure, the following embodiments are provided along with illustrations to facilitate the disclosure of the present disclosure.

DETAILED DESCRIPTION OF THE PREFERRED EMBODIMENTS

The aforementioned illustrations and following detailed description are exemplary for the purpose of further explaining the scope of the present disclosure. Other objectives and advantages related to the present disclosure will be illustrated in the following description and appended drawings.

[An Embodiment for an LED Display Device According to the Present Disclosure]

Figure 1:
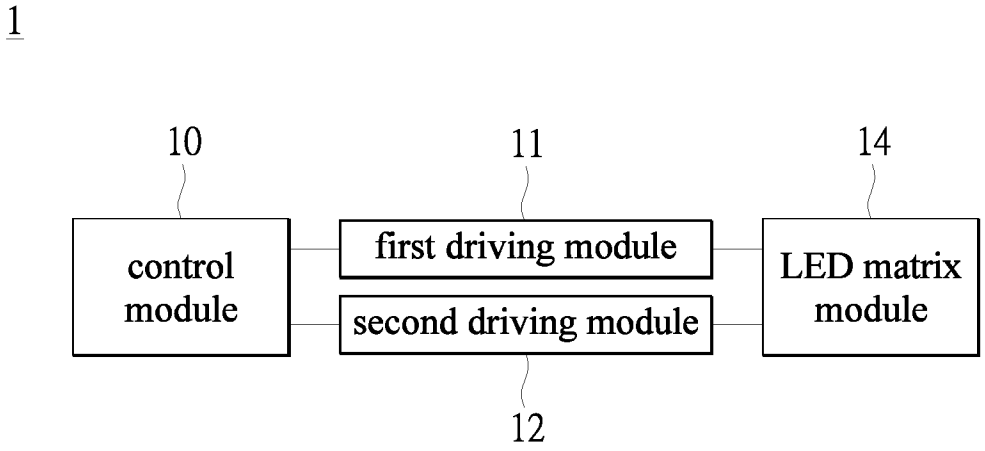
FIG. 1 (PRIOR ART)
FIG. 1 is a schematic view illustrating a conventional LED display device.
Figure 2:
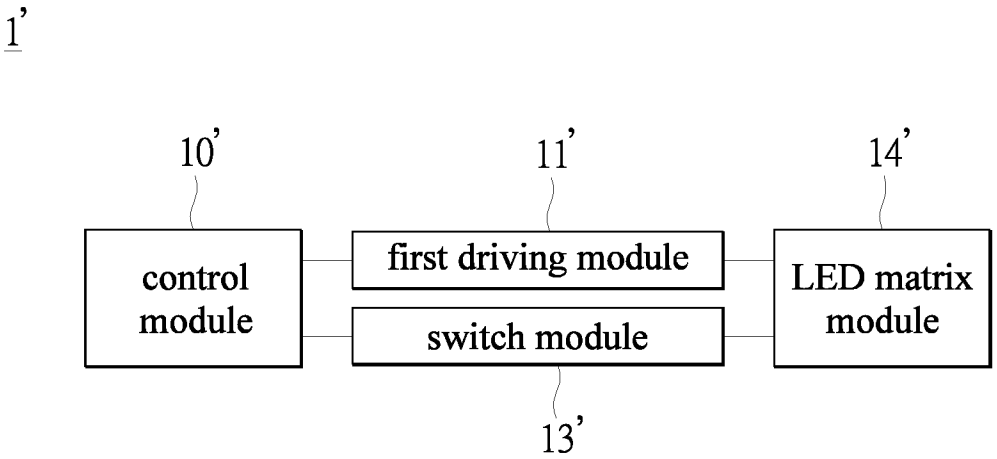
FIG. 2 is a schematic view illustrating an LED display device according to an embodiment of the present disclosure.
Figure 3:
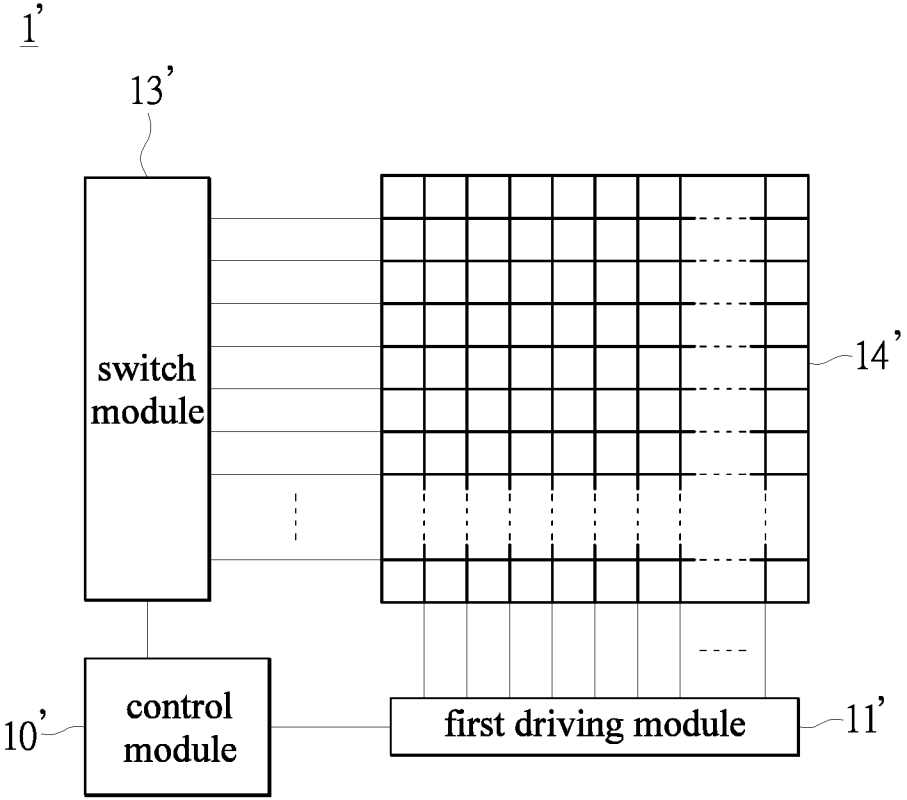
FIG. 3 is another schematic view illustrating the LED display device according to an embodiment of the present disclosure.
Figure 4:
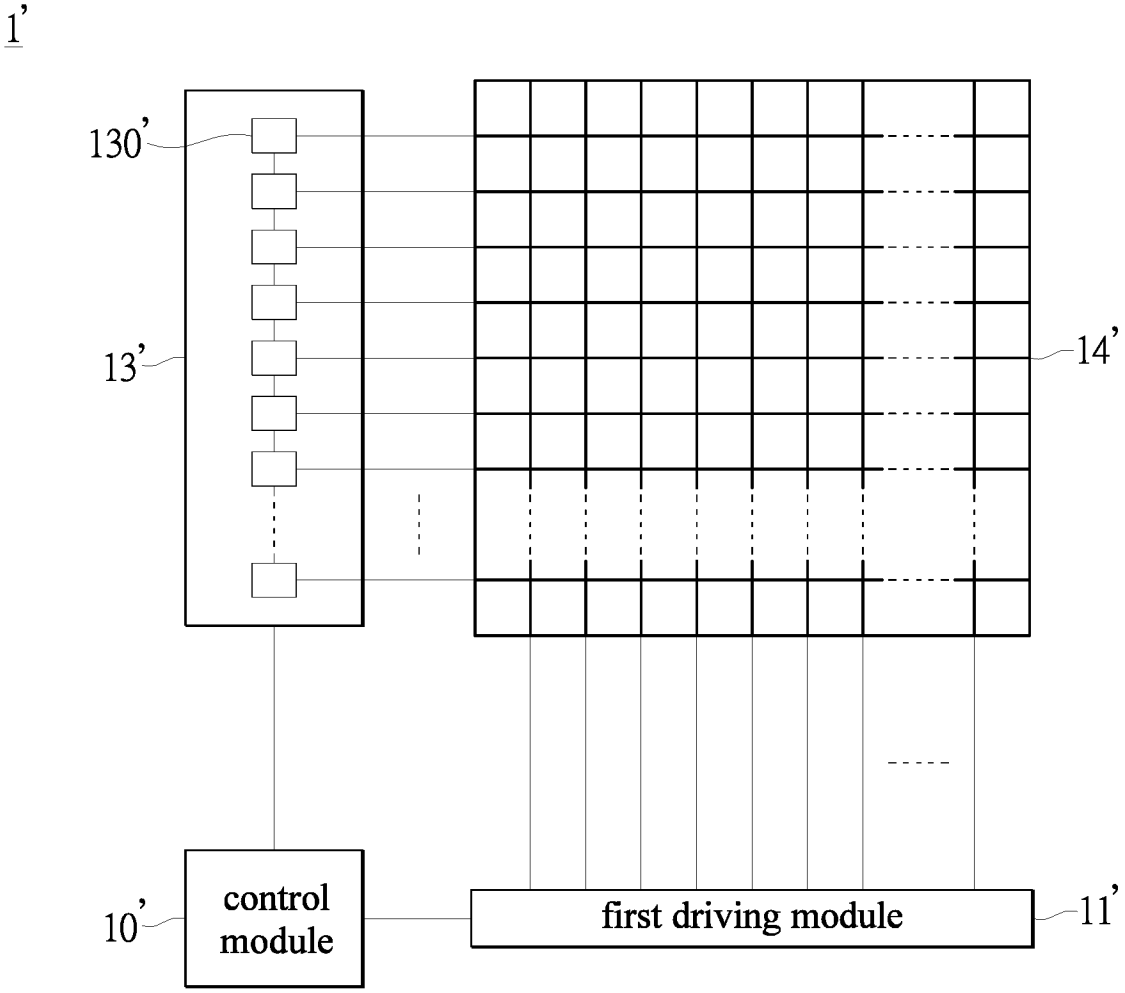
FIG. 4 is another schematic view illustrating the LED display device according to an embodiment of the present disclosure.

Reference is made to FIGS. 2-4, where FIG. 2 is a schematic view illustrating an LED display device according to an embodiment of the present disclosure, FIG. 3 is another schematic view illustrating the LED display device according to an embodiment of the present disclosure and FIG. 4 is another schematic view illustrating the LED display device according to an embodiment of the present disclosure.

The LED display device 1' includes a control module 10', a first driving module 11', a switch module 13' and an LED matrix module 14'. The control module 10', the first driving module 11' and the switch module 13' are an LED driving circuit.

In the present embodiment, the control module 10' electrically connects with the first driving module 11' and the switch module 13'. The first driving module 11' and the switch module 13' respectively electrically connect with the LED matrix module 14'.

The LED matrix module 14' includes a plurality of LED units arranged in a matrix manner. The matrix includes M rows and N columns. Each column has an M number of LED units, and each row has an N number of LED units. In the present embodiment, the LED matrix module includes M×N LED units.

The first driving module 11' provides a first driving signal to drive each column of the LED units (not shown in the figure) on the LED matrix module 14'. The switch module 13' includes a plurality of switch units 130' respectively electrically connecting with each column of the LED units (not shown in the figure) on the LED matrix module 14'. The switch units 130' of the switch module 13' are electrically connected in series.

In the present embodiment, the first driving signal of the first driving module 11' can be, but not limited to, a voltage driving signal or a current driving signal. In the present embodiment, the first driving signal of the first driving module 11' is a pulse width modulation (PWM) signal. However, in other embodiments, the first driving signal of the first driving module 11' can be in other forms, and thus should not be limited thereto.

The first driving module 11' provides each column of LED units (not shown in the figure) with the first driving signal to drive each of the LED units in the column. The control module 10' provides the switch module 13' with a second driving signal. In the present embodiment, the switch units 130' of the switch module 13' turn on each of the LED units (not shown in the figure) in each row in order. That is to say, after the second driving signal is transmitted to a first one of the switch units 130', the second driving signal will be transmitted to a next one of the switch units 130', so that the next one of the switch units 130' can be turned on, and the LED units (not shown in the figure) on each row can thus be turned on in sequence. In the present embodiment, each of the switch units 130' is a flip-flop (FF), which is capable of decreasing the interference caused by noise. In terms of circuit layout, the complicated wiring can also be simplified. In the present embodiment, there is no limitation to the second driving signal of the control module 10', and the second driving signal can be adjusted to meet practical demands.

[Another Embodiment for an LED Display Device According to the Present Disclosure]

Figure 5:
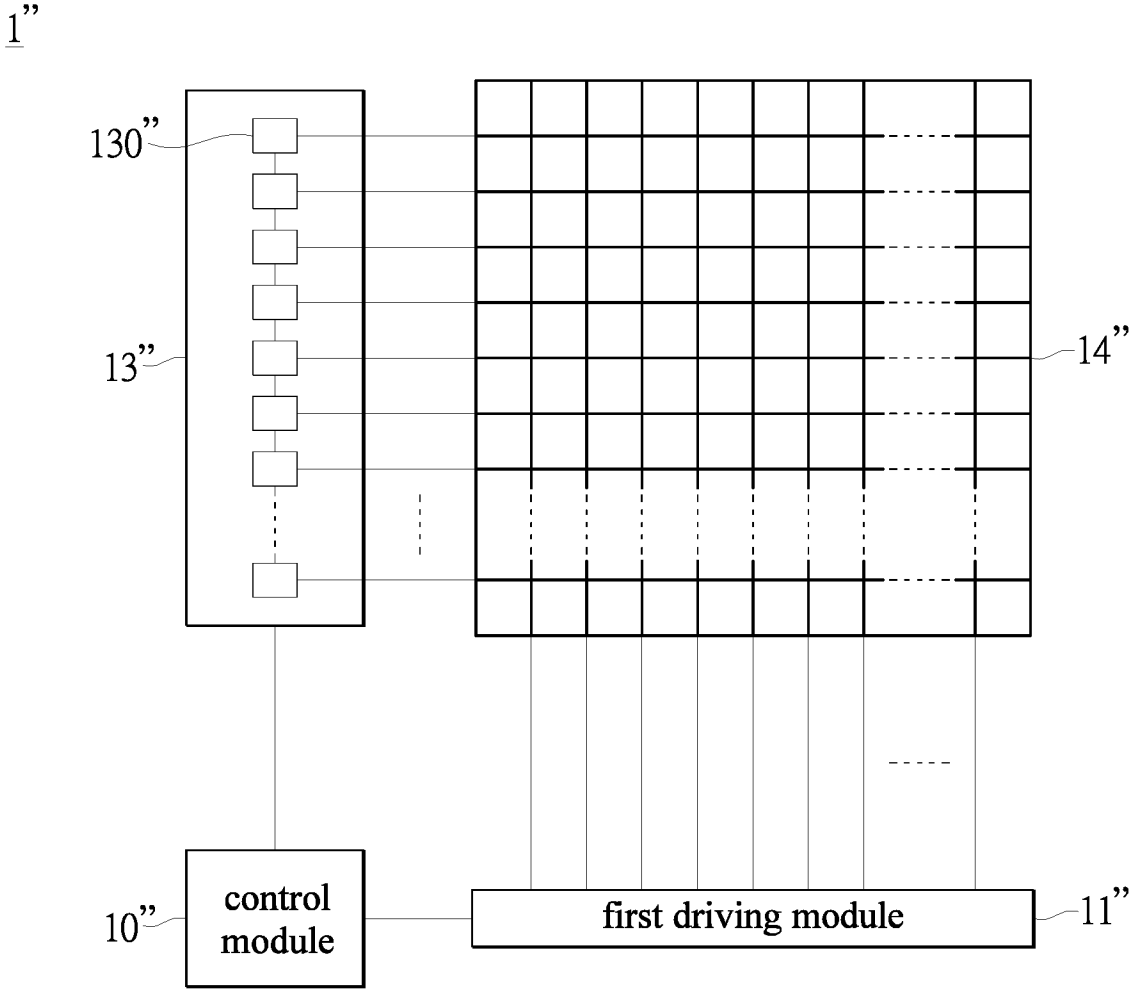
FIG. 5 is a schematic view illustrating the LED display device according to another embodiment of the present disclosure.
Figure 6:
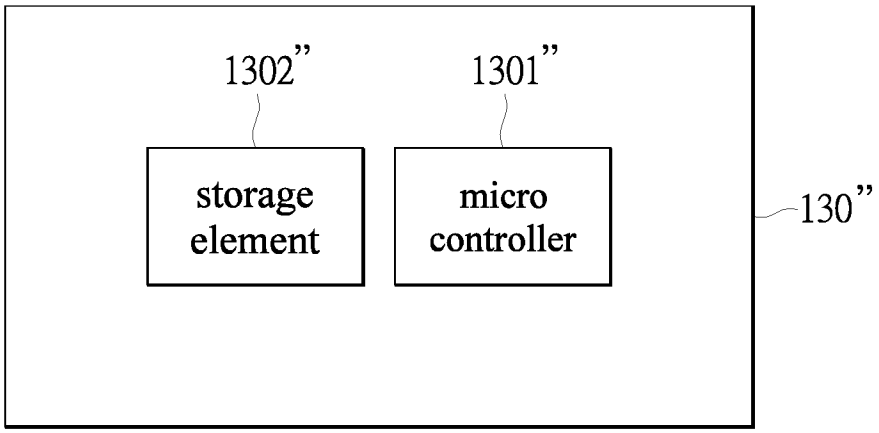
FIG. 6 is a schematic view illustrating the switch unit shown in FIG. 5.

Reference is next made to FIGS. 5-6, where FIG. 5 is a schematic view illustrating the LED display device according to another embodiment of the present disclosure and FIG. 6 is a schematic view illustrating the switch unit shown in FIG. 5.

The LED display device 1" includes a control module 10", a first driving module 11", a switch module 13" and an LED matrix module 14".

In the present embodiment, the control module 10" electrically connects with the first driving module 11" and the switch module 13". The first driving module 11" and the switch module 13" respectively and electrically connect with the LED matrix module 14". The control module 10", the first driving module 11" and the switch module 13" are an LED driving circuit.

The LED matrix module 14" includes a plurality of LED units (not shown in the figure) arranged in a matrix manner. The matrix includes M rows and N columns. Each column has an M number of LED units and each row has an N number of LED units. In the present embodiment, the LED matrix module 14" includes M×N LED units.

The first driving module 11" provides a first driving signal to drive each column of the LED units (not shown in the figure) on the LED matrix module 14". The switch module 13" includes a plurality of switch units 130" respectively electrically connecting with each column of the LED units (not shown in the figure) on the LED matrix module 14". The switch units 130" of the switch module 13" are electrically connected in series.

In the present embodiment, the first driving signal of the first driving module 11" can be, but not limited to, a voltage driving signal or a current driving signal. In the present embodiment, the first driving signal of the first driving module 11" is a pulse width modulation (PWM) signal. However, in other embodiments, the first driving signal of the first driving module 11" can be in other forms, and thus should not be limited thereto.

The first driving module 11" of the LED matrix module 14" provides each column of LED units (not shown in the figure) with the first driving signal to drive each of the LED units in the column. The control module 10" provides the switch module 13" with a second driving signal. In the present embodiment, the switch module 13" includes an M number of switch units 130", and the M number of switch units 130" are electrically connected in series. That is to say, the switch module 13" includes a first one of the switch units 130" to the $M^{th}$ one of the switch units 130", each electrically connecting with the M row LED units of the LED matrix module 14". In the present embodiment, there is no limitation to the second driving signal of the control module 10", and the second driving signal can be adjusted to meet practical demands.

In the present embodiment, each switch unit 130" includes a micro controller 1301" and a storage element 1302". The micro controller 1301" is configured to receive the second driving signal of the control module 10".

The driving signal provided by the control module 10" to the switch module 13" includes at least one address information to drive the switch unit 130" on a certain row that has an address corresponding to the address information. That is to say, in the present embodiment, the control module 10" can transmit an arbitrary address information to drive the LED units (not shown in the figure) in a certain row having a corresponding address information. In the present embodiment, the micro controller 1301" of the switch unit 130" can decode the driving signal with the address information transmitted by the control module 130". The decoded address information would be compared with an address data stored in the storage element 1302". If the decoded address information matches with the address data stored in the storage element 1302", then the corresponding micro controller 1301" will turn on the electrically connected LED unit (not shown in the figure).

In the present embodiment, the control module 10" transmits the second driving signal to a first one of the switch units 130", and then transmits the second driving signal to a next one of the switch units 130". Each of the switch units 130" respectively decodes the address information from the second driving signal for the comparison with the address data, and then turns on the corresponding row of LED units (not shown in the figure). In other embodiments, the control module 10" can simultaneously transmit the second driving signal to all of the switch units 130" of the switch module 13", and each switch unit 130" simultaneously decodes the second driving signal to retrieve the decoded address information and to turn on the corresponded row of LED units (not shown in the figure) in sequence according to the decoded address information.

[Possible Effects of the Embodiments]

In sum, by utilizing the switch module, the LED driving circuit according to the embodiments of the present disclosure is capable of simplifying the circuit layout, and decreasing the degree of complexity of the control method by utilizing the switch module, whereby the cost can be decreased and the development process of the products can be speeded up.

The description illustrated supra set forth simply the preferred embodiments of the present disclosure; however, the characteristics of the present disclosure are by no means restricted thereto. All changes, alterations, or modifications conveniently considered by those skilled in the art are deemed to be encompassed within the scope of the present disclosure delineated by the following claims.

What is claimed is:

1. An LED driving circuit, adapted to drive an LED matrix module including a plurality of LED units, comprising:

a control module;

a first driving module electrically connected to the control module and receiving a first driving signal provided by the control module, the first driving module electrically connected to the LED matrix, the first driving module driving at least one column of the LED units of the LED matrix module according to a first driving signal provided by the control module; and a switch module electrically connected to the control module, configured to receive a second driving signal from the control module to drive the at least one row of the LED units of the LED matrix module;

wherein the switch module includes at least one micro controller and at least one storage element, the second driving includes at least one address information, the micro controller of the switch module compares with the at least one address information of the second driving and at least one address data of the storage element to select a certain row of the LED units of the LED matrix corresponding to the address information for driving.

2. The LED driving circuit according to claim 1, wherein the control module, by the switch module, drives each row of the LED units of the LED matrix module in order.

3. The LED driving circuit according to claim 1, wherein the control module, by the switch module, drives an arbitrary row of the LED units of the LED matrix module.

4. An LED display device, comprising:

an LED matrix module including a plurality of LED units arranged in a matrix manner;

a control module;

a first driving module, first driving module, electrically connected to the control module and receiving a first driving signal provided by the control module, the first driving module electrically connected to the LED matrix, the first driving module providing the first driving signal to drive at least one column of the LED units of the LED matrix module; and a switch module electrically connected to the control module, configured to receive a second driving signal from the control module to drive the at least one row of the LED units of the LED matrix module;

wherein the switch module includes at least one micro controller and at least one storage element, the second driving includes at least one address information, the micro controller of the switch module compares with the at least one address information of the second driving and at least one address data of the storage element to select a certain row of the LED units of the LED matrix corresponding to the address information for driving.

5. The LED display device according to claim 4, wherein the control module, by the switch module, drives each row of the LED units of the LED matrix module in order.

6. The LED display device according to claim 4, wherein the control module, by the switch module, drives an arbitrary row of the LED units of the LED matrix module.

* * * * *